US005613454A

United States Patent [19]

Adamski, Jr. et al.

[11] Patent Number: 5,613,454

[45] Date of Patent: Mar. 25, 1997

[54] VACUUM LATCHTACK THROAT PLATE WITH A VACUUM GENERATING APPARATUS

[75] Inventors: Maximilian Adamski, Jr., Tega Cay, S.C.; Stephen S. Ruderman, Matthews, N.C.; Marian Pawlowski, Fort Mill, S.C.

[73] Assignee: Union Special Corporation, Charlotte, N.C.

[21] Appl. No.: 366,324

[22] Filed: Dec. 29, 1994

[51] Int. Cl.[6] ..... D05B 65/06

[52] U.S. Cl. ..... 112/260; 112/287; 112/188; 112/DIG. 1

[58] Field of Search ..... 112/33, 165, 197, 112/260, DIG. 1, 288, 287

[56] References Cited

U.S. PATENT DOCUMENTS

| | | | |
|---|---|---|---|
| 2,579,059 | 12/1951 | Vanadia . | |
| 3,143,987 | 8/1964 | Daniel et al. . | |
| 3,215,106 | 11/1965 | Bono . | |
| 3,223,059 | 12/1965 | Jacobs . | |
| 3,320,915 | 5/1967 | Steiner . | |
| 3,379,151 | 4/1968 | Tiemann . | |
| 3,448,708 | 6/1969 | Ross . | |
| 3,490,403 | 1/1970 | Boucraut . | |
| 3,511,202 | 5/1970 | Strauss et al. . | |
| 3,548,768 | 12/1970 | Juenemann et al. . | |
| 3,557,730 | 1/1971 | Armstead, Jr. . | |
| 3,581,716 | 6/1971 | Teed . | |
| 3,593,991 | 7/1971 | Baron et al. . | |
| 3,624,734 | 11/1971 | Schips . | |
| 3,688,336 | 9/1972 | Costello, Jr. et al. . | |
| 3,698,336 | 10/1972 | Launer . | |
| 3,815,533 | 6/1974 | Bray | 112/252 |
| 3,922,983 | 12/1975 | Schips et al. . | |
| 3,986,467 | 10/1976 | Hornkohl . | |
| 4,038,933 | 8/1977 | Marforio | 112/288 |
| 4,091,756 | 5/1978 | von hagen . | |
| 4,149,478 | 4/1979 | Sanvito et al. . | |
| 4,187,793 | 2/1980 | Fietta et al. . | |
| 4,220,105 | 9/1980 | Palacino . | |
| 4,453,481 | 6/1984 | Garnett et al. . | |
| 4,599,960 | 7/1986 | Brusasca et al. . | |
| 4,607,583 | 8/1986 | Biermann et al. . | |
| 4,644,884 | 2/1987 | Tatsumi . | |
| 4,679,515 | 7/1987 | Keeton . | |

(List continued on next page.)

FOREIGN PATENT DOCUMENTS

| | | | |
|---|---|---|---|
| 26120 | 10/1963 | Germany | 112/260 |

OTHER PUBLICATIONS

Atlanta Attachment Company, Exibition Catalog 91/92, Model AP–26s backlatching needle plate, pp. 13 and 343.

"Make Short Work of Knit Sleeves," Union Special Corporation (1990).

(List continued on next page.)

*Primary Examiner*—Ismael Izaguirre

*Attorney, Agent, or Firm*—Brinks Hofer Gilson & Lione

[57] ABSTRACT

The current invention involves a vacuum latchtack throat plate with a vacuum generating system. The throat plate includes a body having a first internal bore beginning at a front edge of the body and extending longitudinally therethrough, and a channel formed in the lower surface of the body. The throat plate further includes a stitch tongue having a front edge and back edge, where the stitch tongue is integrally formed with the body. The stitch tongue has a second internal bore beginning at the back edge and extending longitudinally through the stitch tongue to the body where the channel couples the second internal bore to the first internal bore.

The vacuum generating system includes a source of positive pressure gas, a vacuum generator having an input port, an outlet port and a vacuum port, and a valve for coupling the source to the input port of the vacuum generator. The valve is controllable. The vacuum generating system further includes a conduit coupling the vacuum port of the vacuum generator to the throat plate.

18 Claims, 4 Drawing Sheets

U.S. PATENT DOCUMENTS

| | | | |
|---|---|---|---|
| 4,738,210 | 4/1988 | Keeton . | |
| 4,763,590 | 8/1988 | Kojima et al. . | |
| 4,796,552 | 1/1989 | Adamski, Jr. . | |
| 4,800,830 | 1/1989 | Adamski, Jr. . | |
| 4,825,785 | 5/1989 | Adamski, Jr. . | |
| 4,829,920 | 5/1989 | Dippert et al. . | |
| 4,858,546 | 8/1989 | Adamski, Jr. et al. . | |
| 4,878,445 | 11/1989 | Adamski, Jr. et al. . | |
| 4,896,619 | 1/1990 | Adamski, Jr. et al. . | |
| 4,903,623 | 2/1990 | Adamski, Jr. et al. . | |
| 4,911,092 | 3/1990 | Adamski, Jr. et al. . | |
| 4,922,842 | 5/1990 | Adamski, Jr. et al. . | |
| 4,934,009 | 5/1989 | Van Eyk . | |
| 4,972,787 | 11/1990 | Adamski, Jr. et al. . | |
| 5,159,889 | 11/1992 | Price et al. | 112/253 X |
| 5,203,270 | 4/1993 | Price et al. . | |

OTHER PUBLICATIONS

"Union Special 2800 LTS–2," in *See How To Sew It All at Union Special Booth #1830,* at 45, 1988 Bobbin Show, Atlanta, Georgia.

"Now Latchtacking is Simple," Union Special Corporation (1988).

"Union Special 2800 HSLT–1," in *See How To Sew It All at Union Special Booth #1430,* at A, 1989 Bobbin Show, Atlanta, Georgia.

"2800 HSLT/1", in JUKI/Union Special, at 43, Samab, Milan (1989).

"Union Special 2800 HSLTE 1," in *Sewing Equipment For All Your Fashions,* at 34, 1991 Bobbin Show, Atlanta, Georgia.

"Union Special 2800 ULT1," in *Sewing Equipment For All Your Fashions,* at 35, 1991 Bobbin Show, Atlanta, Georgia.

"NO if's . . . NO and 's . . . NO knots," Atlanta Attachment Company, The Needle's Eye, p. 13, Apr./May 1991.

"Make Short Work of Knit Sleeves," Union Special Corporation (1992).

"Automated Systems' Sleeve Seaming With Latch–Tacking–2800 ULT–1," Union Special Corporation (1992).

"Air Vac: Series HAV Vacuum Transducer Pump," Air Vac, p. 9.

"Vacuum Generator, VTR–1 Standard Specifications," Fabco, pp. 15.1–15.2, Nov. 20, 1990.

Photograph—1. Top view of throat plate with vacuum tube soldered thereto.

Photograph—2. Bottom view of throat plate with vacuum tube soldered thereto.

VACUUM LATCHTACK THROAT PLATE WITH A VACUUM GENERATING APPARATUS

BACKGROUND OF THE INVENTION

The invention relates to a pneumatic device for retaining and positioning a thread chain and, more particularly, to an improved vacuum latchtack throat plate with a vacuum generating apparatus.

Generally, a sewing machine for forming an overedge chain stitch has a sewing needle, loopers, and a stitch tongue for forming the thread chain, and a presser foot, feed dogs and a throat plate for cyclically advancing a work piece through the sewing needle. The stitch tongue, which acts like a knitting needle around which the thread chain is formed, is typically part of the throat plate.

In sewing a series of work pieces with a manual, semi-automatic or automatic sewing machine that produces an overedge chain stitch in the work pieces, the sewing machine continues its sewing operation for a time after the work piece has passed through a stitch forming region of the sewing machine. This continued operation of the sewing machine creates a thread chain extending back toward the sewing needles from the trailing edge of each work piece. Typically, the thread chain is severed from the work piece after the trailing edge of the work piece moves beyond the throat plate of the sewing machine.

After the thread chain is severed from the work piece, a portion of the thread chain remains attached to the sewing needle. This portion of the thread chain will then become attached to the leading edge of the next work piece passing through the sewing needle.

In order to improve the appearance of the finished work pieces and to prevent unraveling of the seam in the work pieces, the portion of the thread chain that is attached to the sewing needle must be positioned and retained upstream in the line of feed from the sewing needle. The portion of the thread chain is positioned so that it may then be oversewn into the seam an the leading edge of the next work piece. The process of oversewing the thread chain into a seam at a leading edge of a work piece is known as latchtacking.

Devices are known for retaining and positioning a portion of a thread chain to be oversewn into a seam at the leading edge of a work piece. For example, U.S. Pat. No. 4,038,933 to Marforio includes a vacuum operated device for latchtacking a thread chain. A throat plate includes a longitudinal channel, which extends through the entire length of the throat plate and a stitch tongue. The longitudinal channel is coupled by a conduit to a switching valve. The switching valve is coupled by a second conduit to a vacuum unit. A trim knife is located adjacent to the throat plate.

A disadvantage of the Marforio device is that the vacuum is supplied to the throat plate through the switching valve. The switching valve will typically have small vacuum passageways that may become clogged or partially blocked by lint, dust, thread pieces and the like, which are ingested through the stitch tongue. In addition, the location of the switching valve may increase the distance between the vacuum unit and the throat plate, thereby increasing the time required to obtain vacuum at the stitch tongue once the valve is switched. It is desirable to mount the vacuum source close to the stitch tongue and to precisely control the timing of the application of the vacuum.

A further disadvantage of the Marforio device is that the trim knife is positioned to the right of the straight longitudinal channel. The trim knife trims the edges of the work piece before the work piece reaches the sewing needles. Because the trim knife is positioned to the right of the longitudinal channel, the resulting seam width size may be unacceptable on many work pieces.

U.S. Pat. No. 5,159,889 to Price et al. also includes a vacuum operated device for latchtacking a thread chain. A throat plate includes an air conduit that terminates in an opening at a chaining tongue. The air conduit extends from the throat plate to a vacuum canister, where the air conduit is coupled to an internal control valve assembly suspended from the lid of the canister. When the internal control valve is open, reduced air pressure within the canister draws a stream of air through the air conduit. The reduced air pressure within the canister is established by coupling the canister to an inlet conduit of a venturi. The venturi is coupled to a high pressure air line by a valve.

A disadvantage of the Price device is that the vacuum canister is physically large making mounting close to the throat plate difficult. In addition, the vacuum canister requires regular maintenance to remove the lint, dust, thread pieces and the like that are drawn through the opening in the air conduit and into the canister. Furthermore, because vacuum is drawn through the internal control valve assembly, the presence of such debris on the valve element of the internal control valve assembly may prevent the internal control valve from completely closing. It is desirable to mount the vacuum source close to the stitch tongue and to minimize required maintenance.

A further disadvantage of the Price device is that two valves are utilized, the internal control valve assembly and the valve coupling the venturi to the high pressure line. It is desirable to minimize the number of components used in the vacuum system. In addition, the time required to evacuate the canister with this valve arrangement may limit the number of work pieces that can be produced in a given time.

Another known device for retaining and positioning a portion of a thread chain to be oversewn into a seam at the leading edge of a work piece is available from Atlanta Attachment Company of Lawrenceville, Ga. The device includes a thin-walled vacuum tube that is soldered to the underside of the throat plate and stitch tongue. The thin-walled vacuum tube is soldered to a vacuum conduit at the front edge of the throat plate.

A disadvantage of this device is that the stitch tongue may not be hardened and polished after the thin-walled vacuum tubing is soldered in place. It is desirable to harden and polish all surfaces of the stitch tongue because the thread chain is formed around the stitch tongue and should smoothly slide over the stitch tongue. Surfaces of the stitch tongue that have not been hardened are subject to needle nicks, which may cause the thread chain to snag and necessitate replacement of the entire throat plate. In addition, with the thin-walled tubing, which is formed and then soldered in place, the stitch tongues on a series of throat plates may not be consistently dimensioned, leading to greater set up times when replacing a throat plate. Furthermore, the vacuum conduit may not be readily reformed or repositioned.

Accordingly, it would be desirable to have an improved vacuum latchtack throat plate and vacuum generating apparatus.

SUMMARY OF THE INVENTION

The current invention involves a throat plate including a body having a first internal bore beginning at a front edge of the body and extending longitudinally therethrough, and a channel formed in the lower surface of the body. The throat plate further includes a stitch tongue having a front edge and back edge, where the stitch tongue is integrally formed with the body. The stitch tongue has a second internal bore beginning at the back edge and extending longitudinally through the stitch tongue to the body where the channel couples the second internal bore to the first internal bore.

In another aspect of the invention, a vacuum generating system for applying vacuum to a stitch tongue on a throat plate is provided. The vacuum generating system includes a source of positive pressure gas, a vacuum generator having an input port, an outlet port and a vacuum port, and a valve for coupling the source to the input port of the vacuum generator. The valve is controllable. The vacuum generating system further includes a conduit coupling the vacuum port of the vacuum generator to the throat plate.

DETAILED DESCRIPTION OF THE INVENTION AND PREFERRED EMBODIMENTS

Figure 1A:
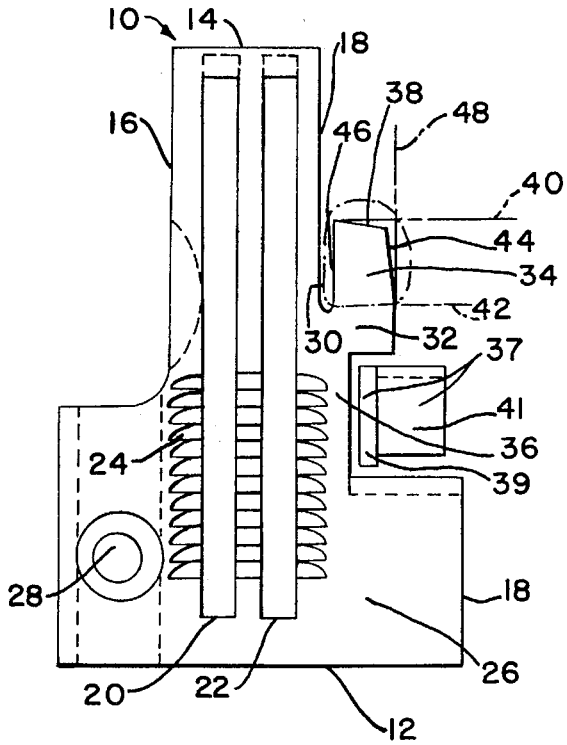
FIG. 1A is a top view of a throat plate in accordance with the present invention.

The present invention is best understood by reference to the embodiments shown in FIGS. 1 through 4 in which like elements are referred to by like numerals. FIG. 1A is a top view of a throat plate 10 in accordance with the present invention. The throat plate 10 has a front edge 12, a back edge 14, a left edge 16 and a right edge 18. Two longitudinal closed slots 20 and 22 are machined into the throat plate 10. Twelve grooves 24, oriented substantially perpendicular to the slots 20 and 22, are cut into an upper surface 26 of the throat plate 10. A screw may be driven through a mounting hole 28 to secure the throat plate 10 to the bed of a sewing machine (not shown). The slots 20, 22 and grooves 24 operatively associate with a presser foot and feed dogs in a conventional manner to cyclically advance a work piece 29, as shown in FIG. 1D, through a stitch forming region 30.

The throat plate shown in the accompanying Figures may be used with a Model 39500 overedge sewing machine manufactured by Union Special Corporation. The Model 39500 overedge sewing machine may produce a class 503 or a class 504 sewing stitch, and may be adapted for manual or automatic operation. Alternatively, the invention may be adapted for use on other sewing machines, including sewing machines for producing other classes of sewing stitches, to perform the latchtack function.

Referring again to FIG. 1A, a platform 32 extends from the right edge 18 of the throat plate 10. A stitch tongue 34 extends generally toward the back edge 14 of the throat plate 10 from the platform 32. The portion of the throat plate 10 exclusive of the stitch tongue 34 is referred to herein as a body 36 of the throat plate 10. Thus, the platform 32 is part of the body 36 of the throat plate 10.

A trim knife 37 may be mounted adjacent to the body 36 of the throat plate 10 in the notch to the front of the platform 32. The trim knife 37 includes a lower stationary blade 39 and an upper moving blade 41. The location of the trim knife 37, as shown in FIG. 1D, in front of the stitch tongue 34 provides a narrow seam width.

The stitch tongue 34 has a back edge 38, which is angled with respect to a line 40 parallel to the back edge 14 of the throat plate 10, as shown in FIG. 1A. The angle between the back edge 38 of the stitch tongue 34 and the line 40 is preferably 8.7 degrees, although other angles may be acceptable. The interface between the stitch tongue 34 and the platform 32 is referred to herein as a front edge 42 of the stitch tongue 34. The stitch tongue 34 also has a right edge 44 and a left edge 46.

As shown in FIG. 1A, the right edge 44 of the stitch tongue 34 angles toward the left edge 46 of the stitch tongue 34 such that the distance between the right edge 44 and the left edge 46 is greatest at the front edge 42 of the stitch tongue 34. The angle between the right edge 44 and a line 48 perpendicular to the platform 32 is preferably 7.6 degrees, although other angles may be acceptable. The distance between the right edge 44 and the left edge 46 is referred to herein as the width of the stitch tongue 34.

Figure 2A:
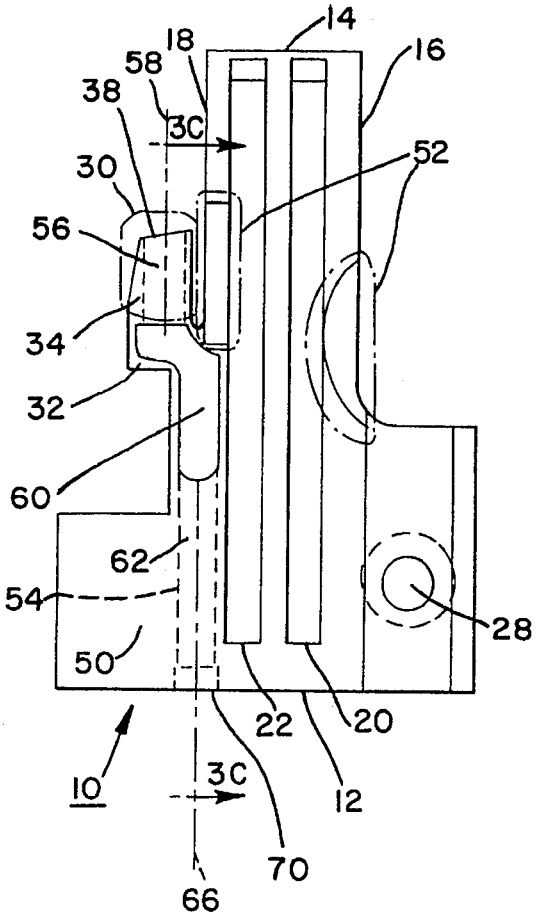
FIG. 2A is a bottom view of the throat plate shown in FIG. 1A.

FIG. 2A is a bottom view of the throat plate 10 shown in FIG. 1A. The throat plate 10 has a lower surface 50, which is preferably machined in an area 52 along the left edge 16 and the right edge 18 to prevent interference between the cyclically moving loopers (not shown) and the throat plate 10 during the sewing operation.

Figure 3A:
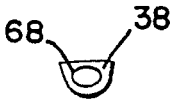
FIG. 3A is a view of a back edge of a stitch tongue on the throat plate shown in FIGS. 1A–1D and 2A–2B.
Figure 3B:
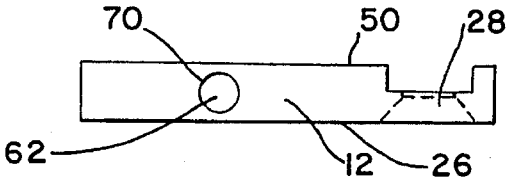
FIG. 3B is a view of a front edge of the throat plate shown in FIGS. 1A–1D and 2A.
Figure 3C:
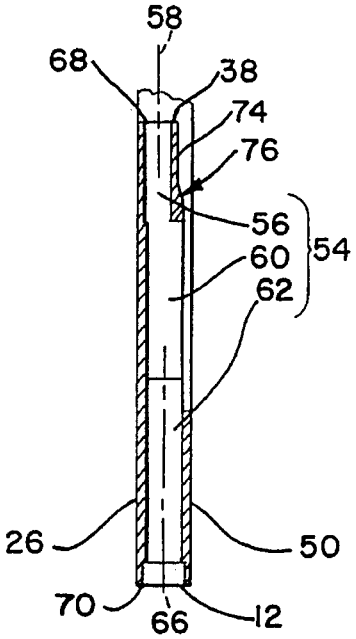
FIG. 3C is a sectional view of a vacuum passageway extending between the back edge of the stitch tongue shown in FIG. 3A and the front edge of the throat plate shown in FIG. 3B.

A vacuum passageway 54 between the front edge 12 of the throat plate 10 and the back edge 38 of the stitch tongue 34 is shown in phantom in FIG. 2A. FIG. 3C is a sectional view of the vacuum passageway 54 extending between the back edge 38 of the stitch tongue 34, as shown in FIG. 3A, and the front edge 12 of the throat plate 10, as shown in FIG. 3B. For sewing machines having the trim knife 37 positioned as shown in FIG. 1A, the vacuum passageway 54 is preferably formed from three interconnected segments.

The first segment is an internal bore 56 within the stitch tongue 34, as shown in FIG. 2A. The internal bore 56 begins at the back edge 38 of the stitch tongue 34 and extends longitudinally through the stitch tongue 34. A longitudinal axis 58 extends axially through the center of the internal bore 56. FIG. 3A is a view of the back edge 38 of the stitch tongue 34 on the throat plate 10 showing an opening 68 on the back edge 38 formed by the internal bore 56. Preferably, the internal bore 56 is formed using an electric discharge machining ("EDM") process.

As shown in FIG. 3C, the stitch tongue 34 has a lower surface 74 with a radius 76 so that the stitch tongue 34 does not interfere with the operation of the loopers (not shown). When the throat plate 10 is used with the Union Special Model 39500 sewing machine, the lower surface 74 preferably is 0.105 inches (0.267 cm ) below the upper surface 26 of the throat plate 10 and the radius 76 is approximately 0.109 inches (0.277 cm ). The dimensions are determined by the desired seam width.

The second segment of the passageway 54 is a channel 60 machined into the lower surface 50 of the throat plate 10, as shown in FIG. 2A. The channel 60 intersects the internal bore 56. Preferably, the channel 60 does not extend into the stitch tongue 34, but rather intersects the internal bore 56 on the platform 32. Prior to use of the throat plate 10, the channel 60 is sealed with a cover (not shown), which may be soldered into place or secured by other means, such as a screw. Notably, the cover for the channel 60 does not extend into the stitch forming region 30, and therefore the cover does not contact either the thread chain or the work piece during sewing. Preferably, the walls of the channel 60 are machined so that the cover fits flush with the lower surface 50 of the throat plate 10.

The third segment of the passageway 54 is an internal bore 62 within the body 36 of the throat plate 10, as shown in FIG. 2A. The internal bore 62 begins at an opening 70 on the front edge 12 of the throat plate 10, as shown in FIG. 3B, and extends longitudinally into the throat plate 10, where the internal bore 62 intersects the channel 60. A longitudinal axis 66 extends axially through the center of the internal bore 62. The internal bore 62 may be formed using EDM, drilling or other known machining techniques. Preferably, the internal bore 62 is counterbored at the front edge 12 of the throat plate 10 for attaching the throat plate to a vacuum source 64. The counterbored portion of the internal bore 62 may be tapped.

Alternatively, the bore 62 within the body 36 of the throat plate 10 may begin at an opening on the right edge 18 of the throat plate 10 and extend into the throat plate 10, where the bore 62 intersects with the channel 60. With this alternative arrangement of the third segment, the work piece will not pass over the conduit 72 during sewing.

Because the vacuum passageway 54 includes the internal bore 56 in the stitch tongue 34, the stitch tongue 34 may be machined from the stock parent metal used for the throat plate 10. Where a throat plate body and a stitch tongue, including the upper and lower surfaces and left and right edges of the stitch tongue, are machined from the same piece of stock parent material, the stitch tongue is referred to herein as being integrally formed with the throat plate body.

Preferably, the parent material for the throat plate 10 and integrally formed stitch tongue 34 is a tool steel, such as S7 tool steel, although any other machinable and heat treatable material may alternatively be used. Since the stitch tongue 34 is integrally formed with the throat plate 10, all surfaces of the stitch tongue 34, including the left edge 46, the right edge 44, the lower surface 74, and the walls of the internal bore 56, may be heat treated and polished, although it is not necessary to heat treat the walls of the internal bore 56. Preferably, the machined throat plate 10 is heat treated to provide a hardness of HV-600 minimum and a core hardness of HRC 42 maximum.

Several advantages are realized by constructing the passageway 54 as described herein. For example, the snitch tongue 34, being hardened on all thread contacting surfaces, is more durable allowing nicks formed on the stitch tongue during its use to be removed by polishing. In addition, throat plates in accordance with the present invention may be machined with stitch tongues having consistent outer dimensions, making the throat plates more interchangeable and producing more consistent thread chains. Furthermore, because the stitch tongue 34 is entirely formed from the parent metal, the walls of the internal bore 56 may be hardened and polished to prevent snagging of the thread chain.

Figure 1B:
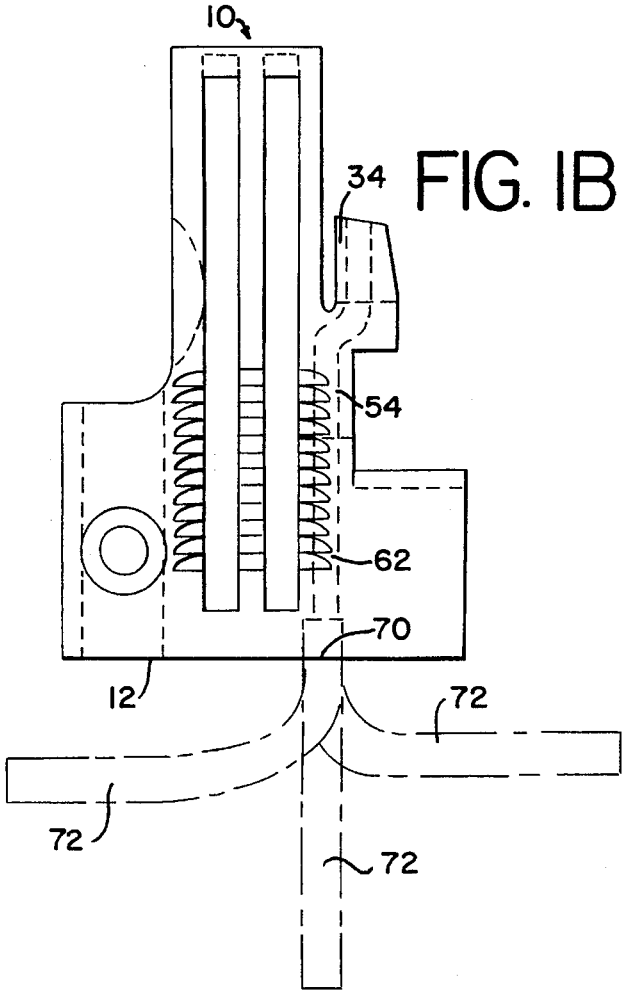
FIGS. 1B and 1C illustrate alternative configurations for a vacuum conduit attached to the throat plate of FIG. 1A.
Figure 1C:
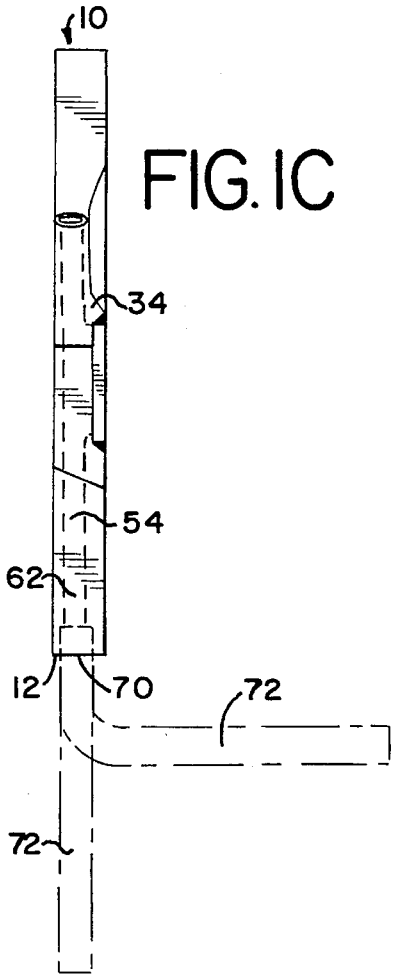
Figure 1D:
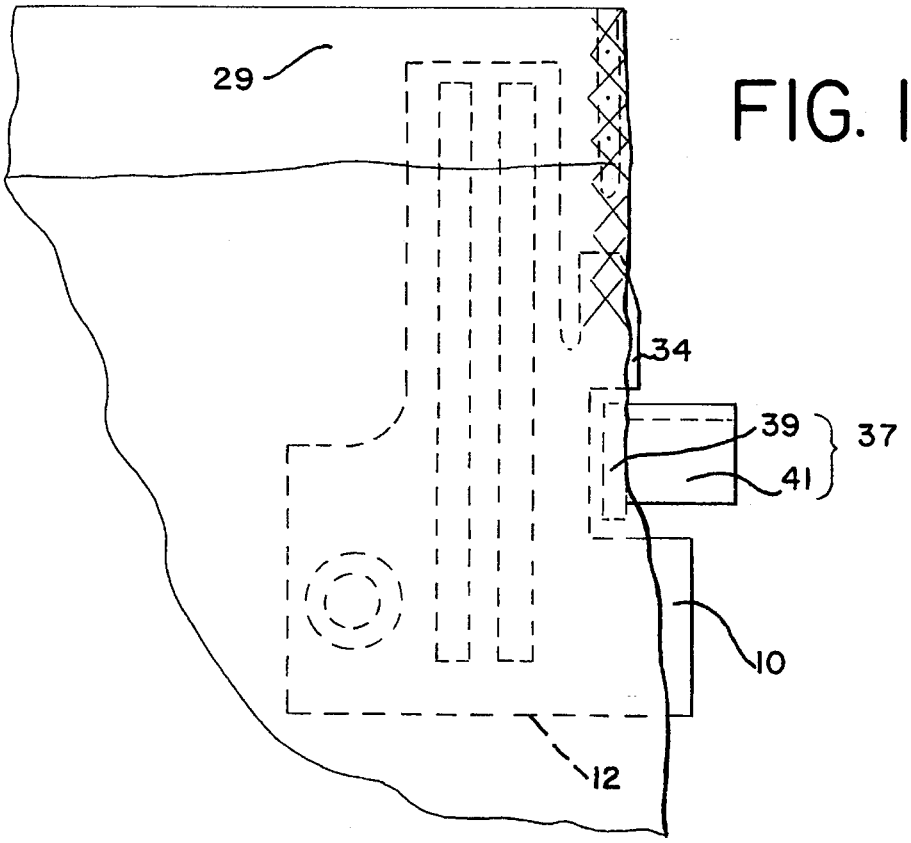
FIG. 1D is a top view of a work piece advancing over the throat plate of FIG. 1A and being trimmed by a trim knife.

Moreover, because the internal bore 62 within the body 36 of the throat plate 10 provides an attachment point on the throat plate 10 for the vacuum source 64, that is, the opening 70 at the front edge 12 of the throat plate 10, the vacuum source 64 may be coupled to the internal bore 62 using any convenient or desirably shaped conduit 72. More specifically, because the conduit 72 is attached to the passageway 54, as opposed to being integrally formed with the passageway 54, the conduit 72 may be replaced or reoriented without consequence to the stitch tongue 34. Also, differently shaped conduits may be used with the throat plate 10 for different applications requiring auxiliary attachments in front of the throat plate 10. FIG. 1B, which is a top view of the throat plate 10, and 1C, which is a right side view of the throat plate 10, illustrate some of the many alternative ways that the conduit 72 may be oriented.

Figure 2B:
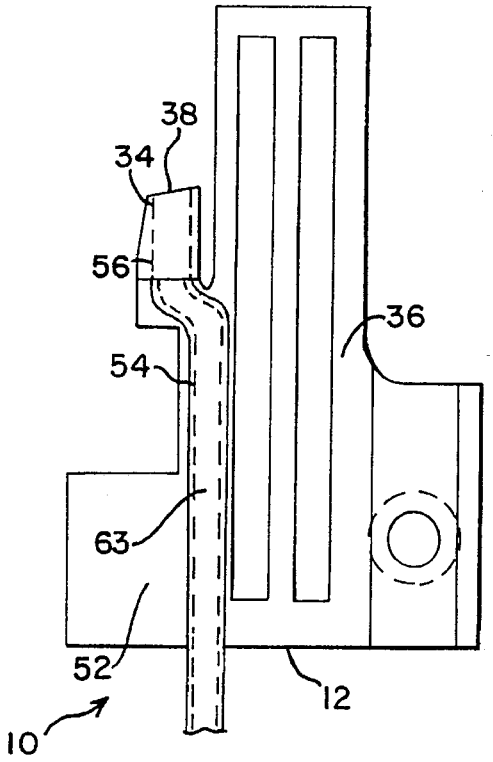
FIG. 2B is a bottom view of an alternative embodiment of the throat plate shown in FIG. 2A.

In alternative embodiments, the vacuum passageway 54 may be formed from two segments. In a first alternative embodiment, shown in FIG. 2B, the channel 60 and the internal bore 62 in the throat plate 10 are replaced by a length of soft steel tubing 63. The tubing 63, shown in FIG. 2B, is essentially formed to match the shape of the channel 60 and the internal bore 62, shown in FIG. 2A. The lower surface 50 of the body 36 is machined to accommodate the steel tubing 63, which is attached to the internal bore 56 in the stitch tongue 34. Thus, the two segments of the vacuum passageway 54 are the length of soft steel tubing 63 and the internal bore 56. In this embodiment, the steel tubing 63 may extend from the throat plate 10 to operate as the conduit 72 to the vacuum source 64. The stitch tongue 34 in the first alternative embodiment is integrally formed with the throat plate 10.

In a second alternative embodiment, the internal bore 56 in the stitch tongue 34 and the channel 60 are replaced by a formed length of soft steel tubing. The lower surface of the stitch tongue 34 and the throat plate 10 are relieved by machining to accommodate the steel tubing, which is attached to the internal bore 62. Thus, the two segments of the vacuum passageway 54 are the length of soft steel tubing and the internal bore 62 within the body 36 of the throat plate 10.

If the trim knife 37 is not required, the vacuum passageway may be formed in a single segment. In FIG. 1A, the notch along the right edge 18 of the throat plate 10 to the front of the platform 32 may accommodate the trim knife 37. If the trim knife 37 is not required, then the notch may be eliminated and the right edge 18 to the front of the platform 32 extended to the right edge of the platform 32. The vacuum passageway 54 may then be formed by machining a bore extending from the back edge 38 of the stitch tongue 34 to the front edge 12 of the throat plate 10. The passageway 54 is preferably formed using electric discharge machining. As above, the passageway 54 may be counterbored at the front edge 12 of the throat plate 10.

Figure 4:
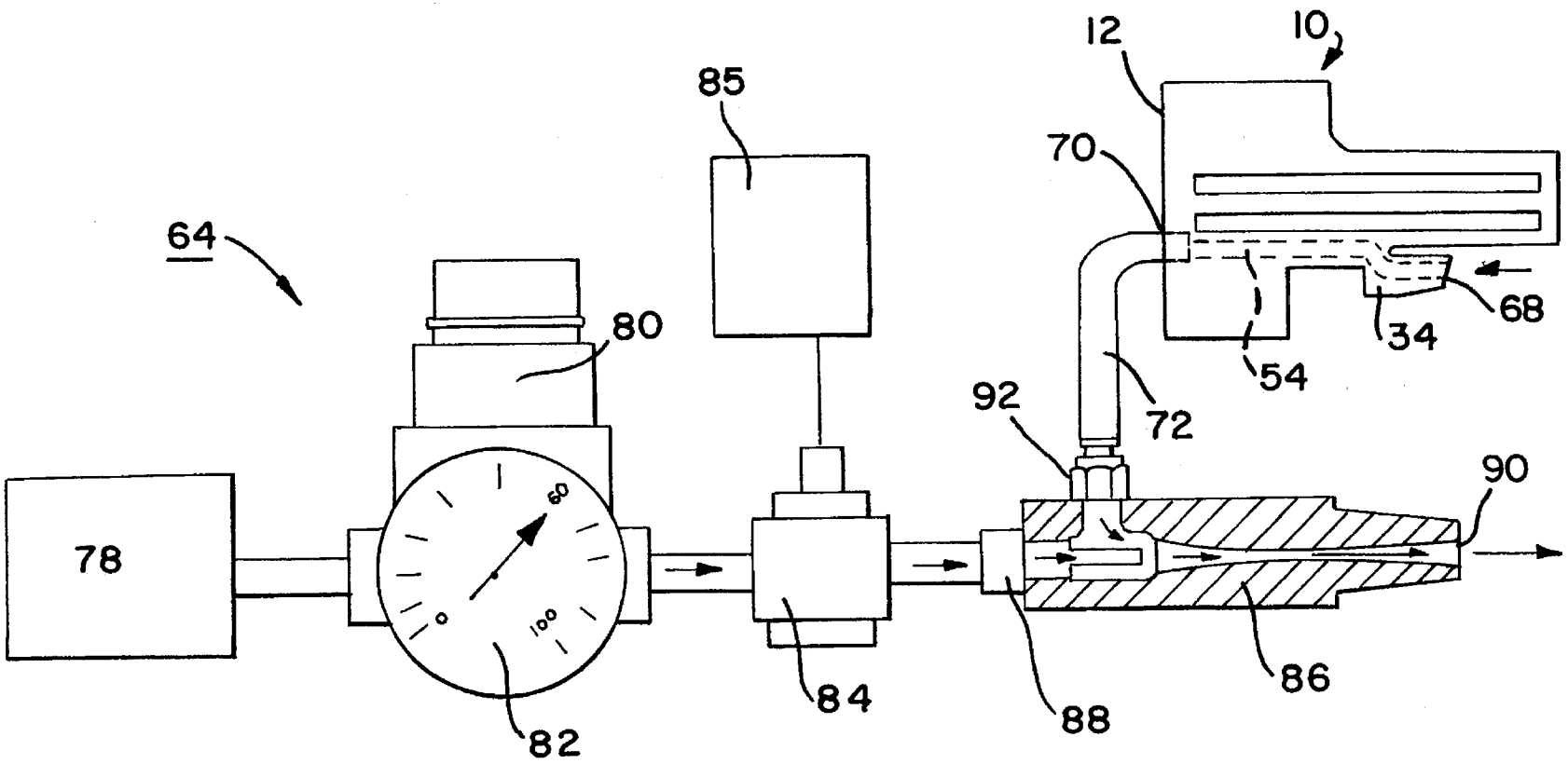
FIG. 4 is a schematic of a vacuum generating system in accordance with the present invention.

Referring now to FIG. 4, a schematic of a vacuum generating system in accordance with the present invention is shown. The vacuum generating system includes an air supply 78, which provides positive pressure. The air supply 78 is preferably coupled to a regulator 80, which may have a gage 82 or other indicator of the pressure level. The regulator 80 is coupled to a valve 84, which is coupled to a controller 85. The air supply 78 may alternatively be directly coupled to the controlled valve 84. When the valve 84 is open, air from the air supply 78 flows through the valve 84. When the valve 84 is closed, the air supply is cut off. The valve 84 output is coupled to a vacuum generator 86.

The vacuum generator 86 has an input port 88 an exhaust port 90 and a vacuum port 92. Between the input port 88 and the exhaust port 90, the vacuum generator 86 forms a venturi with a straight through hole, providing a vacuum at the vacuum port 92. The vacuum generator 86 may exhaust to the atmosphere. A suitable commercially available vacuum generator 86 is supplied by Fabco-Air of Gainesville, Fla. as model VTR-1. A Series HAV Vacuum Transducer Pump as manufactured by Air-Vac Engineering Co. of Milford, Conn. may alternatively be used.

The vacuum port 92 of the vacuum generator 86 is coupled by the conduit 72 to the counterbored opening 70 on the front edge 12 of the throat plate 10. Preferably, the lengths of the conduit 72 and the coupling between the vacuum generator 86 and the valve 84 are minimized. As the valve 84 is controllable, close coupling the valve 84 to the vacuum generator 86 reduces the time delay between switching open the valve 84 and obtaining a vacuum at the stitch tongue 34. The valve 84 is preferably a pneumatically actuated poppet valve, although a solenoid actuated valve may alternatively be used. The valve 84 is preferably controlled by a microprocessor having an input from a sensor, such as a retroreflective sensor, located to monitor the position of the work piece. The valve 84 may alternatively be controlled by an operator, who may throw a switch to apply the actuating signal to the valve 84.

In operation, the air supply is coupled to and flows through the vacuum generator 86 upon application of the required pressure to the pneumatically controlled valve 84. The venturi within the vacuum generator 86 generates vacuum at the vacuum port 92 as the air supply flows from the input port 88 to the exhaust port 90. The vacuum is coupled by the conduit 72 to the passageway 54 in the throat plate 10, ultimately reaching the opening 68 in the stitch tongue 34. Preferably, the openings throughout the passageway 54, the conduit 72 and the path through the vacuum generator 86, between the vacuum port 92 and the exhaust port 90, are larger than the opening 68 to prevent the vacuum generating system from becoming clogged by lint, dust, thread pieces and the like.

The vacuum at the opening 68 serves to draw the end of the portion of the severed thread chain that is attached to the sewing needle into the chaining tongue 34. By varying tension on the sewing threads prior to or in the course of chaining off the thread chain, the thread chain may be made more balanced and flexible, as is known in the art. A balanced and more flexible thread chain may be captured by the stitch tongue more consistently. In addition, it is desirable during the latchtacking operation to sever the balanced thread chain very close to the back edge 14 of the throat plate 10 in order to minimize the length of the severed thread chain and to locate the severed end of the thread chain near the opening 68 in the chaining tongue 34.

Alternatively, or in addition to varying tension on the sewing threads, the thread chain may be stretched before it is severed, as is known and described, for example, in U.S. Pat. No. 4,679,515 to Keeton or in U.S. Pat. No. 5,159,889 to Price et al., to assist in directing the portion of the severed thread chain that is attached to the sewing needle toward the opening 68 in the chaining tongue 34. Several stitches may be chained off during or immediately after severing the thread chain to ensure that the proximal end of the thread chain is located about the chaining tongue.

Figure 1E:
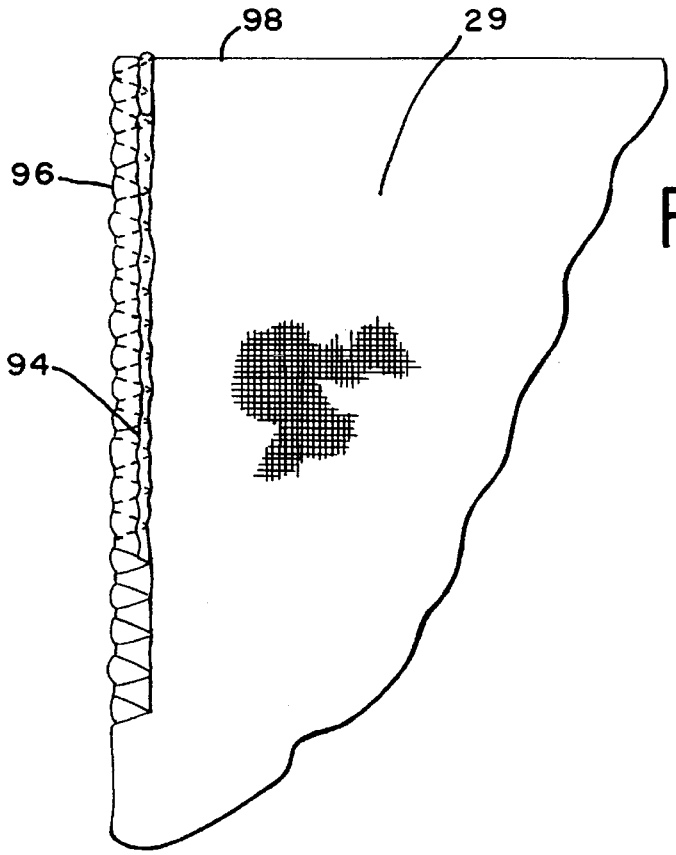
FIG. 1E is a view of a partially seamed work piece having a thread chain oversewn into the seam at a leading edge of the work piece.

The end of the thread chain is thereby positioned and retained within the chaining tongue 34 until the next work piece 29 enters the stitch forming region 30 of the sewing machine. As the work piece 29 is advanced through the stitch forming region 30, the thread chain is withdrawn from the chaining tongue 34 and oversewn into the seam at the leading edge of the work piece 29. As shown in FIG. 1E, a thread chain 94 is oversewn into a seam 96 at a leading edge 98 of the work piece 29. Preferably, vacuum is supplied by the vacuum generator 86 to the stitch tongue 34 as the advancing work piece 29 draws the thread chain out of the stitch tongue 34.

It is envisioned that the severed thread chain will be more easily captured and retained with improvements in the art of vacuum generators. More particularly, when vacuum generators are able to provide greater pressure differentials than are currently available, the balance or length of the thread chain will no longer be consequential. Nor will stretching the thread chain prior to severing it be consequential.

The throat plate 10, as described above, may be used in automated seaming or hemming and seaming sewing machines, as well as in manual or semi-automatic sewing workstations. As is further described above, the vacuum source 64 is preferably controlled by the microprocessor, which has an input from the sensor, such as a retroreflective sensor, located to monitor the position of the work piece. The vacuum source 64 may alternatively be controlled by the operator, who may throw a switch to apply the actuating signal to the valve 84.

It is intended that the foregoing detailed description be regarded as illustrative rather than limiting and that it is understood that the following claims, including all equivalents, are intended to define the scope of the invention.

We claim:

1. A vacuum latchtack throat plate comprising in the direction of a feed line:

body having a front edge and a side edge;

a stitch tongue integrally formed with the body and extending in a direction generally parallel to the side edge of the body, the stitch tongue comprising a back edge and an internal bore beginning at the back edge and extending longitudinally along a first axis; and a conduit coupling the internal bore to the front edge of the body, wherein the conduit is angled from the first axis.

2. A vacuum latchtack throat plate as claimed in claim 1, wherein the conduit is formed from a soft steel tubing.

3. A vacuum latchtack throat plate as claimed in claim 1, wherein the body and the stitch tongue comprise a heat treated material.

4. A vacuum latchtack throat plate as claimed in claim 1, wherein the conduit comprises a second internal bore within the body.

5. A throat plate comprising in the direction of a feed line:

a body having a first internal bore beginning at an edge of the body and extending through a portion of the body, a channel formed in a lower surface of the body and having one end coupled with the first internal bore; and a stitch tongue comprising a back edge and a second internal bore beginning at the back edge and extending longitudinally to the other end of the channel.

6. A vacuum latchtack throat plate as claimed in claim 5, wherein the body and the stitch tongue are formed from a single material.

7. A vacuum latchtack throat plate as claimed in claim 5, wherein a portion of the throat plate comprises a heat treated and polished material.

8. A throat plate as claimed in claim 5, further comprising a cover attached to the lower surface of the body adjacent to the channel.

9. A throat plate as claimed in claim 5, wherein the first internal bore defines a first axis and the second internal bore defines a second axis, wherein the second axis is displaced from the first axis.

10. A throat plate as claimed in claim 5 wherein the stitch tongue is tapered form the front edge to the back edge.

11. A throat plate as claimed in claim 5, wherein the first internal bore includes a counterbored portion at the front edge of the body.

12. A throat plate as claimed in claim 11, wherein the counterbored portion is tapped.

13. A vacuum generating system for applying vacuum to a stitch tongue on a throat plate, comprising:

said throat plate having a front edge and a side edge;

said stitch tongue integrally formed with said throat plate and extending in a direction generally parallel to its side edge;

a vacuum passageway formed in said throat plate, said vacuum passageway having a first opening in said stitch tongue and a second opening in said throat plate at a location remote from said stitch tongue;

a source of positive pressure gas;

a vacuum generator having an input port, an output port and a vacuum port;

a valve for coupling the source to the input port of the vacuum generator; and a continuous non interrupted conduit coupling the vacuum port of the vacuum generator to said second opening in said throat plate at a location remote from said stitch tongue.

14. A vacuum generating system as claimed in claim 13, wherein the invention further comprises a pneumatic actuator connected to said valve.

15. A vacuum generating system as claimed in claim 13, wherein the vacuum generator comprises a venturi.

16. A vacuum generating system as claimed in claim 13, wherein the conduit is coupled to a channel beginning at a front edge of the throat plate and extending through the throat plate and the stitch tongue to a back edge of the stitch tongue forming an opening at the back edge of the stitch tongue.

17. A vacuum generating system as claimed in claim 16, wherein the channel, the conduit and the vacuum generator define a vacuum passageway having a minimum diameter defined by the opening at the back edge of the stitch tongue.

18. A vacuum latchtack throat plate system comprising:

a body having in the direction of a feed line a front edge and a side edge;

a stitch tongue comprising a back edge, wherein the stitch tongue is integrally formed with the body, the stitch tongue further comprising an internal bore beginning at the back edge and extending longitudinally;

a conduit coupling the internal bore to the body; and a vacuum source coupled to the conduit, wherein the vacuum source comprises a vacuum generator having an input port, an exhaust port and a vacuum port coupled to the conduit.

* * * * *